United States Patent [19]

Hart et al.

[11] Patent Number: 4,606,800

[45] Date of Patent: Aug. 19, 1986

[54] COATING METHOD AND PRODUCT THEREOF

[75] Inventors: Robert G. Hart, Bethlehem; Herbert E. Townsend, Center Valley, both of Pa.

[73] Assignee: Bethlehem Steel Corporation, Bethlehem, Pa.

[21] Appl. No.: 534,011

[22] Filed: Sep. 20, 1983

[51] Int. Cl.[4] ..... C25D 13/20

[52] U.S. Cl. ..... 204/181.1; 427/385.5; 427/388.1; 427/409; 427/410; 428/328; 428/334; 428/336; 428/339; 428/418; 428/425.8; 428/548

[58] Field of Search ..... 428/328, 548, 418, 334, 428/336, 339, 425.8, 457, 458; 427/385.5, 388.1, 409, 410

[56] References Cited

U.S. PATENT DOCUMENTS

| | | | |
|---|---|---|---|
| 4,238,532 | 12/1980 | Dreulle | 427/433 |
| 4,317,857 | 3/1982 | Kanda et al. | 428/416 |
| 4,350,540 | 9/1982 | Allegra et al. | 428/635 |
| 4,366,185 | 12/1982 | Tanaka et al. | 428/418 |
| 4,456,663 | 6/1984 | Leonard | 427/399 |
| 4,473,110 | 9/1984 | Zawierucha | 428/933 |
| 4,479,832 | 10/1984 | Hart et al. | 148/6.14 R |

OTHER PUBLICATIONS

Chemical Abstract No. 78:73762v, Japanese Pat. No. JP 47/27765, Jul. 24, 1972.

*Primary Examiner*—Amelia B. Yarbrough
*Attorney, Agent, or Firm*—William B. Noll

[57] ABSTRACT

This invention is directed to a coating method and to the product produced by such method. In the preferred practice of this invention, the method includes the steps of selecting a ferrous substrate, such as steel sheet preferably containing a first coating having certain corrosion resistant and adhesion-promoting characteristics, and applying thereto an outer coating of an organic resin containing a particulate metallic aluminum-zinc alloy which is between 5 and 95% by weight aluminum, balance zinc. Preferably, the particle size of said alloy is no more than about 10 microns. Such product is ideally suited for the subsequent application of a cathodic electrophoretic primer coat, such as widely used in the automotive industry.

6 Claims, No Drawings

COATING METHOD AND PRODUCT THEREOF

BACKGROUND OF THE INVENTION

The present invention relates to a coating method and to the product resulting from such coating method. Such product is an ideal candidate for the application of a cathodic electrophoretic coating or e-coat.

Briefly, the coating technology to which the present invention relates is described in the literature under such terms as cathodic electrodeposition, cathodic electrophoretic coating, or e-coating. Such technology was developed in the mid-1970's and is now widely practiced in the automotive and appliance industries. While there may be other and varied applications for this technology, for convenience herein, reference will be made to the problems and advances made in the automotive industry as this is an industry which has experienced the greatest pressures to perfect such technology.

The automotive industry is under increasing pressure to meet the demands of the consuming public wanting automobiles that "won't rust", yet presenting a pleasing appearance. Supporting the public is the government with its potential power to demand higher quality in the form of a longer term warranty. Two parties helping to relieve such pressure are the steel industry which supply the steel sheet for the automobile bodies, and the paint industry which supply the eye-appealing and corrosion-resistant paint for such bodies.

The automotive industry has adopted cathodic electrodeposition as a coating method for a number of reasons. Such reasons include the ability to obtain uniform coverage of the substrate, access to all parts of the substrate, increased corrosion protection afforded by cathodic primers, and automation, by way of example. One of the disadvantages or conditions of coating through cathodic electrodeposition is that the substrate must be electrically conductive such as found with steel. Although cathode electrocoat primers provide a degree of corrosion protection, paint on bare steel will not be sufficiently corrosion resistant to satisfy either the consumer or the government in achieving the long awaited "rust-free" automobile. Accordingly, the steel industry and the paint industry have tried a number of approaches to provide a steel product which has a corrosion resistant coating that will be receptive to the application of an e-coat.

One approach to the problem proposed by the steel industry was the use of two sided galvanized steel as a base product to minimize inside-out corrosive attack of the auto body. These attempts failed because the painted part could not meet the automotive industry's criteria for appearance. The steel industry then turned to a zinc-rich paint system applied to only one side of a steel strip on a continuous coil coating paint line. A commercial product utilizing such a system is ZINCROMETAL, a registered trademark of Diamond Shamrock Corporation. ZINCROMETAL is actually a dual cost system wherein the initial coat is a proprietary mixture of chromic acid, zinc dust and other chemicals, while the outer coating is an organic resin containing zinc powder. While ZINCROMETAL coatings appeared to satisfy the requirement for providing adequate protection against the corrosive effects of road salt, such coatings tended to show an inherent surface defect when cathodic electroprimed at high voltages. By high voltages we mean voltages in excess of 250–300 volts, as typically used in the U.S. automotive industry.

In any case these surface defects had the appearance of craters or pinholes in the surface. The subsequent applied outer coating was not sufficient to mask the craters. As a consequence, such coatings were restricted to the non-visible area of an automobile.

The cratering problem is a topic of world-wide interest as evidenced by the following articles.

1. "Problems Associated with the Electrophoretic Deposition of Paint on Galvanized Steel," by L. W. Franks et al, presented at ASM/ADDRG Conference in April 1981 at Dearborn, Mich., and
2. "Multilayer ElectroGalvanized (Zn—Cr—CrOX) Steel Sheet for Optimum Corrosion Protection of Car Bodies," by a. Catanzano et al, presented at SAE Int'l Conference in February–March, 1983 at Detroit, Mich.

In the Franks et al article, cratering is attributed to hydrogen generation. The authors identify two factors with cratering, namely, deposition voltage and deposition current density. Catanzano et al offer an extensive discussion on 'Hydrogen Cratering'. However, rather than attempt to modify the operating conditions of the process, the latter authors propose a multilayer electrogalvanizing process. The result of such process is a coated product, allegedly resistant to cratering, which was given the name ZINCROX, a registered trademark of Zincroksid S.p.A.

Notwithstanding the above work, the present invention is based on the discovery that cratering is not related to hydrogen evolution. By understanding the causes of cratering, it was possible to develop a method for providing a corrosion resistant coating which is not susceptible to cratering when coated with a cathodic electrophoretic primer at voltages in excess of 300 V. Such development, to be described in detail in the specifications which follow, can open the door to the use of e-coats to the visible areas of an automobile.

SUMMARY OF THE INVENTION

This invention relates to a method of pre-coating a ferrous substrate, and to the pre-coated product thereof, which product is suitable for the later application of a cathodic electrophoretic primer coat. The method includes the steps of optionally placing a first coat, layer, or film on a ferrous substrate, such as sheet steel, where such optional coat, layer or film is sufficient to provide some corrosion protection to the underlying ferrous substrate. To said bare substrate, coat, layer or film, as the case may be, an outer coating of an organic resin containing a particulate metallic aluminum-zinc alloy which is between 5 and 95% by weight aluminum, balance zinc. The particle size of said alloy is no more than about 10 microns. This pre-coated product, possessing the Al—Zn alloy particulate containing coating, is particularly suitable for the subsequent application of a cathodic electrophoretic primer coat, which is widely used in the automotive industry.

DETAILED DESCRIPTION OF PREFERRED EMBODIMENT

The present invention is directed to a coating method and to the product produced by such method. The method includes the steps of selecting a ferrous substrate, such as sheet steel preferably containing a first coating having certain corrosion resistant characteristics, and applying thereto an outer coating of an organic resin containing a particulate metallic aluminum-zinc alloy which is between 5 and 95% by weight aluminum, balance zinc. The particle size of said alloy is no more than about 10 microns. In this form the pre-coated product is ideally suited for the subsequent application of a cathodic electrophoretic primer coat.

Cathodic electrophoretic coating or the cathodic electrodeposition process are described by M. Wismer et al in the *Journal of Coatings Technology*, Vol. 54, No. 688, May 1982, at pages 35–44. In such process the deposited film is applied to the cathode which is the substrate upon which a coating is desired. The reactions and mechanisms are defined by Wismer et al as follows:

"Cathodic electrolytes are polymers with basic moiety in the form of primary, secondary, or tertiary amines, or quaternary ammonium, sulfonium, or phosphonium groups, neutralized with organic or inorganic acids. They form positively charged resin micelles in aqueous media.

When such a polymer is dispersed in water and supplied with conductive electrodes and direct current, the following physical processes and chemical reactions occur.

Electrophoresis: The positively charged particles or micelles, under the influence of the electric field, migrate to the cathode:

CATHODIC REACTIONS:

Electrolysis of water-$2H_2O+2e \rightarrow H_252 + 2OH$

Film deposition—$NR_2H^+ + OH \rightarrow NR_2 \uparrow + H_2O$

ANODE REACTIONS: (Assumes inert anode)

Electrolysis of water-$2H_2O \rightarrow 4H^+ O_2 \uparrow + 4e$

Electroosmosis: The deposited film is adherent and develops a high resistance. The high voltage gradient across the film produces a phenomenon known as electroosmosis in which water and anions migrate towards the anode and are squeezed out of the film. This results in a very concentrated deposit, normally less than 10% water."

As shown by the above cathodic reactions, hydrogen is given off at the cathode. Presumably this is the basis for the widely held hydrogen evolution theory as the cause of cratering.

During the development of the present invention, a different theory evolved as the cause of cratering. Studies during such development have shown that e-coat cratering is caused by the following sequence of events:

1. Electrical discharges occur through the e-coat film during deposition.
2. Localized heating at the discharge sites causes premature, localized curing of the paint film while still in the paint bath.
3. During paint-cure baking, paint in the prematurely cured areas does not flow to fill voids—resulting in craters in the fully cured paint film.

Dismissal of the hydrogen cratering theory in favor of the above made it possible to develop a fresh approach to the problem.

This fresh approach resulted in the discovery that the use of an aluminum-zinc alloy powder, rather than zinc powder alone, or a mixture of zinc powder and aluminum powder, was the answer to permitting cathodic electrophoretic coating at high voltages without cratering. This fact will become clearer in the description hereinafter.

While it remains a theory as to why the Al—Zn alloy powder is effective, when a mixture of the separate metallic powders is not effective, the following is offered as explanation for the phenomenon. In the coating process, typical pH values necessary for cathodic electrodeposition are high, usually in the range of 12–14. In such a process utilizing a zinc powder dispersed in the coating bath, the zinc was found to dissolve as Zinc hydroxide at pH values above about 9. It was theorized that ZnOH interfered with the paint deposition by causing changes to the dielectric properties of the coating. However, when the zinc is combined with aluminum as an alloy, such problems are not encountered. The data which is presented later in Table I appears to support this theory, at least the finding that as the quantity of metallic zinc powder increases the threshold voltage level drops to some value well below 300 V.

Table I sets forth the approximate maximum voltages (Vm), at which a crater-free cathodic electrophoretic coating can be deposited on various substrates. Insofar as the automotive industry is concerned, a minimum of about 300 V is necessary for the coating process to be acceptable for production purposes. In any event, for the purposes of this comparative study, all pre-coated substrates were coated with an organic coating produced by PPG Industries, Inc. under the designation ED3002 cathodic electrocoat bath. The designated metal powder in the coating of the substrate was approximately 60 Vol.%.

TABLE I

| Test | Substrate | Vm |
|---|---|---|
| 1 | Steel | 400–425 V |
| 2 | Zinc powder-filled organic coating on steel | 225–250 V |
| 3 | 55% Al powder + 45% Zn powder-filled organic coating on steel | 225–250 V |
| 4 | 90% Al powder + 10% Zn powder-filled organic coating on steel | 275–300 V |
| 5 | Al powder-filled organic coating on steel | 375–400 V |
| 6 | 55% Al – 45% Zn alloy powder-filled organic coating on steel | 375–400 V |

NOTE:
powder mix is by weight %.

As expected, the bare steel was readily coated, without the formation of craters, at voltages well in excess of 300 V. However, of the five (5) pre-coated substrates, only #5 and #6 were crater-free when coated at voltages in excess of 300 V. Between these two successful candidates, only #6, pre-coated product of this invention, offers galvanic protection to the underlying steel base. Without such galvanic protection, rust would soon appear at cut edges or in areas where the coating is prematurely damaged.

A significant discovery, as evidenced by the data of Table I, is that the metal filler in the film consists of aluminum-zinc alloy particles and not a mixture of aluminum particles and zinc particles (note #3). The coating containing the aluminum-zinc powder is nearly as resistant to cratering as the uncoated bare steel (note #1).

While it is critical to use an alloy powder in the practice of this invention, the alloy thereof may be varied from 5 to 95%, by weight aluminum, balance essentially zinc. Within such broad range there is the preferred range of 25 to 70%, aluminum, or more preferably 40 to 60%, aluminum, balance essentially zinc.

A preferred product of this invention is one which includes the steps of applying a first corrosion inhibiting layer to the steel base prior to the application of the coating of this invention. An example of such a first coating is the coating described in U.S. Pat. No. 3,687,738, to Malkin, and directed to a coating of $CrO_3$ and pulverulent metal, such as zinc dust, in a liquid medium. After suitable drying and curing of the coating, the thus coated steel base is ready for the coating of this invention.

The coating of this invention may be applied to the bare steel, or precoated steel, as the case may be, by any conventional method for applying a liquid coating to a substrate, for example, dip coating, roller coating, spray or brush coating, etc. By any of such methods, the coating thickness should be in the range of about 0.6 to 1.0 mil. However, before applying the e-coat, the coating of this invention must be cured. A typical curing treatment is one which includes heating the invention coated product to a peak metal temperature of 550° F., followed by water quenching and air drying of the product.

The about product, insofar as the automotive industry is concerned, is an intermediate product. However, it is a product to which an eye-appealing e-coat may be applied, at voltages in excess of 300 V, without cratering.

To further demonstrate the effectiveness of this invention, and to provide an exemplary teaching of the practice thereof, the following is presented.

1. A low-carbon steel sheet was selected and suitably cleaned by an alkaline cleanser to remove grease and oxides which may be present on the sheet surface.
2. A slurry of an organic coating was prepared, the formulation of which is as follows:

| Ingredients | lbs/100 gal. |
|---|---|
| a. BAKELITE Phenoxy Resin PKHH (solid) | 123 |
| b. MPA-60/xylene | 6.5 |
| c. CELLOSOLVE Acetate | 432.5 |
| d. Toluene | 86.7 |
| e. LINDE Molecular Sieve 4A | 10.7 |
| f. 55% Al—45% Zn alloy powder (particle size 10 μm) | 650.3 |

Note:
a, c, e - manufactured by Union Carbide.
b - a dispersant, anti-setting agent manufactured by Baker Castor Oil Co.

3. The organic coating was applied to the surface of such steel sheet to a coating thickness of about 0.8 mils.
4. The coated product of (3) was then heated to a steel sheet temperature of 550° F., water quenched and air dried.

While the product of (4) represents the product of this invention, a primer coat was applied thereto to illustrate the suitability of such a product to resist cratering.

5. A bath of a primer paint*, at a temperature of about 80° F. was placed in a receptacle for application to a prepared substrate (product of 4).

*PPG Industries Cathodic Electrocoat Bath 3002 V
Non-volatile solids content=20.9%
pH=6.18
Conductivity=1300 microohms 6. The product of (4), as the cathode, and a stainless steel anode were inserted into such primer bath, and a voltage of 300 V applied therebetween for two (2) minutes.
7. The primer coated cathode, i.e. sheet steel, was removed, rinsed in water, and baked for twenty (20) minutes at 360° F.

A careful inspection of the primer painted sheet steel, processed in accordance with the teachings of this invention, revealed a smooth, crater-free surface.

We claim:

1. A method of producing a coated ferrous substrate resistant to cratering when coated with a cathodic electrophoretic coating at voltages in excess of 300 V, comprising the steps of (a) selecting a ferrous substrate whose surface has been suitably cleaned of grease and oxides,
(b) applying thereto a resinous outer coating having dispersed therein a particulate metallic aluminum-zinc alloy which is between 5 and 95% by weight aluminum and having a particle size of not more than 10 μm, which coating is applied to a depth of between about 0.6 to 1.0 mil,
(c) curing such coating through heating and quenching, and
(d) subjecting said ferrous substrate having said cured coating thereon to a cathodic electrophoretic coating at a voltage in excess of 300 V.

2. The method according to claim 1 wherein said ferrous substrate has been provided with an initial layer possessing corrosion inhibiting properties, prior to the application of such aluminum-zinc alloy containing resinous coating.

3. The method according to claim 1 wherein aluminum is present in said aluminum-zinc alloy in an amount between 30 and 70%.

4. The method according to claim 3 wherein said ferrous substrate has been provided with an initial layer possessing corrosion inhibiting properties, prior to the application of such aluminum-zinc alloy containing resinous coating.

5. The method according to claim 3 wherein aluminum is present in said aluminum-zinc alloy in an amount between 40 and 60%.

6. The method according to claim 5 wherein said ferrous substrate has been provided with an initial layer possessing corrosion inhibiting properties, prior to the application of such aluminum-zinc alloy containing resinous coating.

* * * * *